US005478086A

United States Patent [19]

Aylett

[11] Patent Number: 5,478,086

[45] Date of Patent: Dec. 26, 1995

[54] THEME PARK BOARD GAME

[76] Inventor: Andrew J. Aylett, 131 Valencia Dr., Brick, N.J. 08723

[21] Appl. No.: 409,418

[22] Filed: Mar. 24, 1995

[51] Int. Cl.[6] ..... A63F 3/00

[52] U.S. Cl. ..... 273/243; 273/249

[58] Field of Search ..... 273/236, 242, 273/243, 248, 249, 256

[56] References Cited

U.S. PATENT DOCUMENTS

| | | | |
|---|---|---|---|
| 1,125,867 | 1/1915 | Mohr | 273/243 |
| 3,594,002 | 7/1971 | Glass et al. | 273/249 |
| 3,656,759 | 4/1972 | Carroll | 273/243 |
| 3,759,521 | 9/1973 | Breslow et al. | 273/243 |
| 5,190,292 | 3/1993 | Perry | 273/243 X |
| 5,211,402 | 5/1993 | Ferguson et al. | 273/249 |
| 5,224,862 | 7/1993 | Sullivan | 273/249 X |
| 5,259,623 | 11/1993 | Kanelos | 273/249 |

*Primary Examiner*—William E. Stoll

[57] ABSTRACT

A theme park board game comprising: a game board formed in a planar configuration and including a plurality of structures simulating the star attractions, minor attractions, rides, vendor and food areas normally found in a theme park, the various structures being connected by a plurality of circles, the circles granting players various game related aids and obstacles; the game having a plurality of accessories including: human and animal characters, tokens having differing thicknesses and point values imprinted thereupon, a score tallying device, a chance device, play money formed in a variety of denominations, at least one set of playing cards including a variety of different instructional indicia; and a set of playing rules informing the users how to play the game, each player moving their chosen character the number of circles dictated by the chance device, the players being required to visit specified board structures, players accumulating token points as they traverse the circles and structures of the game, the player with the most token points at the end of the game being declared the winner.

8 Claims, 4 Drawing Sheets

THE THEME PARK GAME

SCORE SHEET

| | GRANDMA | GRANDPA | MOM | DAD | BOY | GIRL |
|---|---|---|---|---|---|---|
| STAR ATTRACTIONS 1ST. 20 OTHERS 10 | | | | | | |
| BIG DIPPER | | | | | | |
| ENCHANTED CASTLE | | | | | | |
| FAIRY CAROUSEL | | | | | | |
| TUNNEL OF LOVE | | | | | | |
| BIG TOP | | | | | | |
| JUNGLE JAUNT | | | | | | |
| MINOR ATTRACTIONS EACH 5 POINTS | | | | | | |
| NIAGARA BARREL RIDE | | | | | | |
| HUCK FINN SLIDE | | | | | | |
| BIG WHEEL | | | | | | |
| 7 DWARF COCONUT SHY | | | | | | |
| FAIRYTALE CRUISE | | | | | | |
| ALADDINS MAGIC CARPET | | | | | | |
| CYCLONE POOL | | | | | | |
| HAUNTED HOUSE | | | | | | |
| CHARACTERS EACH 2 POINTS | | | | | | |
| BEAR | | | | | | |
| SHEEP | | | | | | |
| COW | | | | | | |
| HORSE | | | | | | |
| DOG | | | | | | |
| CHICKEN | | | | | | |
| SOUVENIRS 2/10/15 POINTS | | | | | | |
| BALLOON $2 | | | | | | |
| T SHIRT $10 | | | | | | |
| CUDDLY TOY $15 | | | | | | |
| FOOD & DRINKS 2/5/10 POINTS | | | | | | |
| DRINK $2 | | | | | | |
| SNACK $5 | | | | | | |
| MEAT $10 | | | | | | |
| 20 POINTS | | | | | | |
| FIRST TO LEAVE | | | | | | |
| TOTAL | | | | | | |

FIG 6

THEME PARK BOARD GAME

BACKGROUND OF THE INVENTION

1. Field of the Invention

The present invention relates to a theme park board game and more particularly pertains to entertaining users by traversing the star attractions and other theme park related structures of the game.

2. Description of the Prior Art

The use of board games is known in the prior art. More specifically, board games heretofore devised and utilized for the purpose of entertaining users by playing the game in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,071,135 to Campbell a board game apparatus for the teaching of financial management principles.

U.S. Pat. No. 5,007,650 to Reed et al. discloses a method of playing a board game of college social life.

U.S. Pat. No. 5,190,292 to Perry discloses a shopping board game apparatus.

U.S. Pat. No. 5,169,154 to Borghi discloses a casino board game.

Lastly, U.S. Pat. No. 5,139,266 to Mullins et al. discloses world tour board game.

In this respect, the theme park board game according to the present invention substantially departs from the conventional concepts and designs of the prior art, and in doing so provides an apparatus primarily developed for the purpose of entertaining users by traversing the star attractions and other theme park related structures while proceeding to the finish line of the game.

Therefore, it can be appreciated that there exists a continuing need for a new and improved theme park board game which can be used for entertaining users by traversing the star attractions and other theme park related structures while proceeding to the finish line of the game. In this regard, the present invention substantially fulfills this need.

SUMMARY OF THE INVENTION

In view of the foregoing disadvantages inherent in the known types of board games now present in the prior art, the present invention provides an improved theme park board game. As such, the general purpose of the present invention, which will be described subsequently in greater detail, is to provide a new and improved theme park board game and method which has all the advantages of the prior art and none of the disadvantages.

To attain this, the present invention essentially comprises a new and improved theme park board game comprising, in combination: a game board formed in a planar generally rectangular configuration with parallel long side edges, parallel short side edges, a front portion and a rear portion, the front portion of the board including two structures with the indicia TASK CARD and WISHES and DREAMS imprinted therebelow, the board including a generally rectangular shaped railroad track with rounded corners, the track including a train with a plurality of trailing cars positioned thereupon, the front side edge of the railroad track including the indicia ENTRANCE/EXIT and its related structures positioned adjacent thereto, the interior of the track including a plurality of structures simulating the star attractions, minor attractions, rides, vendor and food areas normally found in a theme park, the various structures being connected by a plurality of paths including path circles therein, some of the path circles entitling the players to receive play money, instructional cards, and other game related aids and obstacles, the board including a generally cylindrical shaped ENCHANTED CASTLE extending upwardly from its approximate center point; a plurality of human and animal characters being included with the apparatus, each character being positioned on a generally planar base to permit movement to any location on the board, the game also including: a plurality of tokens having differing thicknesses and point values imprinted thereupon, a token card including sections for each token value, play money being formed in a variety of denominations, a TASK CARD deck and a WISHES and DREAMS card deck, the cards of each deck including varying indicia with instructions to the player selecting the card, the card decks being positioned upon their corresponding structures on the game board, and a pair of six sided dice for randomly determining the number of spaces a player is to move each turn; and a set of playing rules informing the users how to play the game, the rules indicating that each player must start at the ENTRANCE/EXIT area and roll the dice to move their corresponding character, each player being required to visit all six major attractions, at least one minor attraction, and purchase at least one souvenir and one item of food, players receiving crazy cash of a corresponding dollar amount when landing on a crazy cash path circle, players landing on a path circle including wd therein being required to draw a WISHES AND DREAMS card, players landing on a path circle including a tc therein being required to draw a TASK CARD, players receiving tokens with varying point totals based on food and souvenir purchases, visits to star and minor attractions, and exit from the park, player having visited the six star attractions may return to the exit at which point the game ends, the player with the most token points being declared the winner of the game.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved theme park board game which has all of the advantages of the prior art board games and none of the disadvantages.

It is another object of the present invention to provide a new and improved theme park board game which may be easily and efficiently manufactured and marketed.

It is further object of the present invention to provide a new and improved theme park board game which is of durable and reliable constructions.

An even further object of the present invention is to provide a new and improved theme park board game which is susceptible of a low cost of manufacture with regard to both materials and labor, and which accordingly is then susceptible of low prices of sale to the consuming public, thereby making such theme park board game economically available to the buying public.

Still yet another object of the present invention is to provide a new and improved theme park board game which provides in the apparatuses and methods of the prior art some of the advantages thereof, while simultaneously overcoming some of the disadvantages normally associated therewith.

Still another object of the present invention is to entertain users by traversing the star attractions and other theme park related structures while proceeding to the finish line of the game.

Lastly, it is an object of the present invention to provide a new and improved a theme park board game comprising: a game board formed in a planar configuration and including a plurality of structures simulating the star attractions, minor attractions, rides, vendor and food areas normally found in a theme park, the various structures being connected by a plurality of circles, the circles granting players various game related aids and obstacles; the game having a plurality of accessories including: human and animal characters, tokens having differing thicknesses and point values imprinted thereupon, a score tallying device, chance means, play money formed in a variety of denominations, at least one set of playing cards including a variety of different instructional indicia; and a set of playing rules informing the users how to play the game, each player moving their chosen character the number of circles dictated by the chance means, the players being required to visit specified board structures, players accumulating token points as they traverse the circles and structures of the game, the player with the most token points at the end of the game being declared the winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a perspective illustration of the score sheet which is used in an alternative embodiment of the apparatus.

The same reference numerals refer to the same parts through the various Figures.

DESCRIPTION OF THE PREFERRED EMBODIMENT

Figure 1:
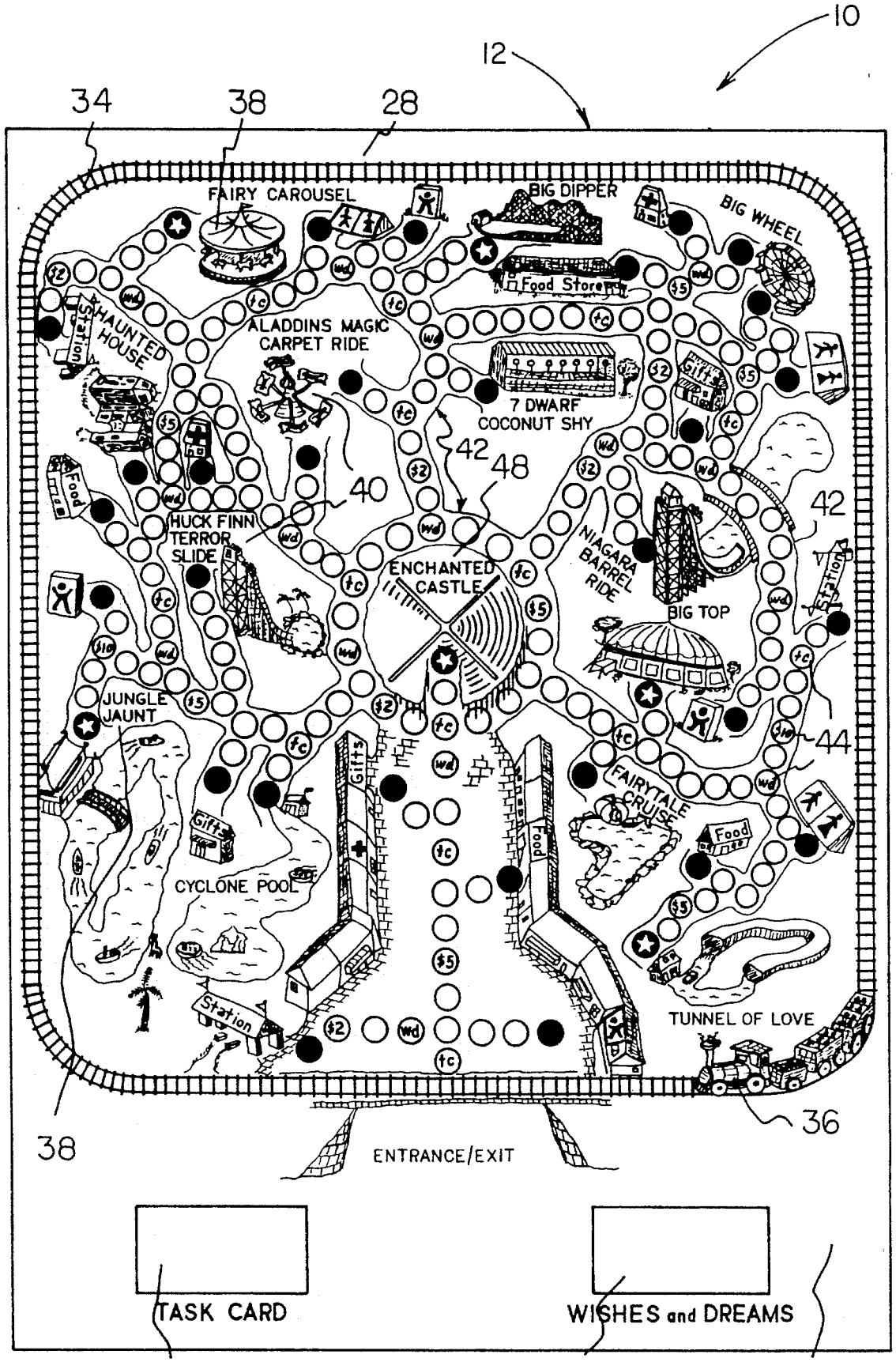
FIG. 1 is a perspective view of the preferred embodiment of the theme park board game constructed in accordance with the principles of the present invention.

With reference now to the drawings, and in particular to FIG. 1 thereof, the preferred embodiment of the new and improved theme park board game embodying the principles and concepts of the present invention and generally designated by the reference numeral will be described.

The present invention, the theme park board game 10 is comprised of a plurality of components. Such components in their broadest context include a game board 12, human characters 14, animal characters 16, tokens 18, play money 20 and a set of playing rules 22. Such components are individually configured and correlated with respect to each other so as to attain the desired objective.

More specifically, the game board 12 is formed in a planar generally rectangular configuration with parallel long side edges, parallel short side edges, a front portion 26 and a rear portion 28. The board may be fabricated of cardboard, plastic, or some other sturdy lightweight material. The front portion of the board includes two structures 30, 32 with the indicia TASK CARD and WISHES and DREAMS, respectively, imprinted below each structure. The TASK CARD deck and optional WISHES and DREAMS card deck are positioned upon these structures during play of the game. Note FIG. 1.

The board includes a generally rectangular shaped railroad track 34 with rounded corners. The track includes a train 36 with a plurality of trailing cars positioned upon it. The front side edge of the railroad track includes the indicia ENTRANCE/EXIT and its related structures positioned adjacent to the indicia. Players begin and end their trip around the park at this location. The area surrounded by the track includes a plurality of structures simulating the star attractions 38, minor attractions 40, rides, vendor and food areas normally found in a theme park. Note FIG. 1.

The various structures are connected by a plurality of paths 42 which have path circles 44 positioned within them. These circle filled paths are referred to as foot paths. The player's characters travel form one structure to another along these foot paths. Some of the path circles entitle the players to receive play money 20, instructional cards, and other game related aids and obstacles. Some of the path circles are blank and entitle the players to nothing. The board includes a generally cylindrical shaped ENCHANTED CASTLE 48 extending upwardly from its approximate center point. The ENCHANTED CASTLE is adapted to simulate the focal point of the theme park. It is positioned in the center of the park as is the case in many real-life parks. Note FIG. 1.

Figure 2:
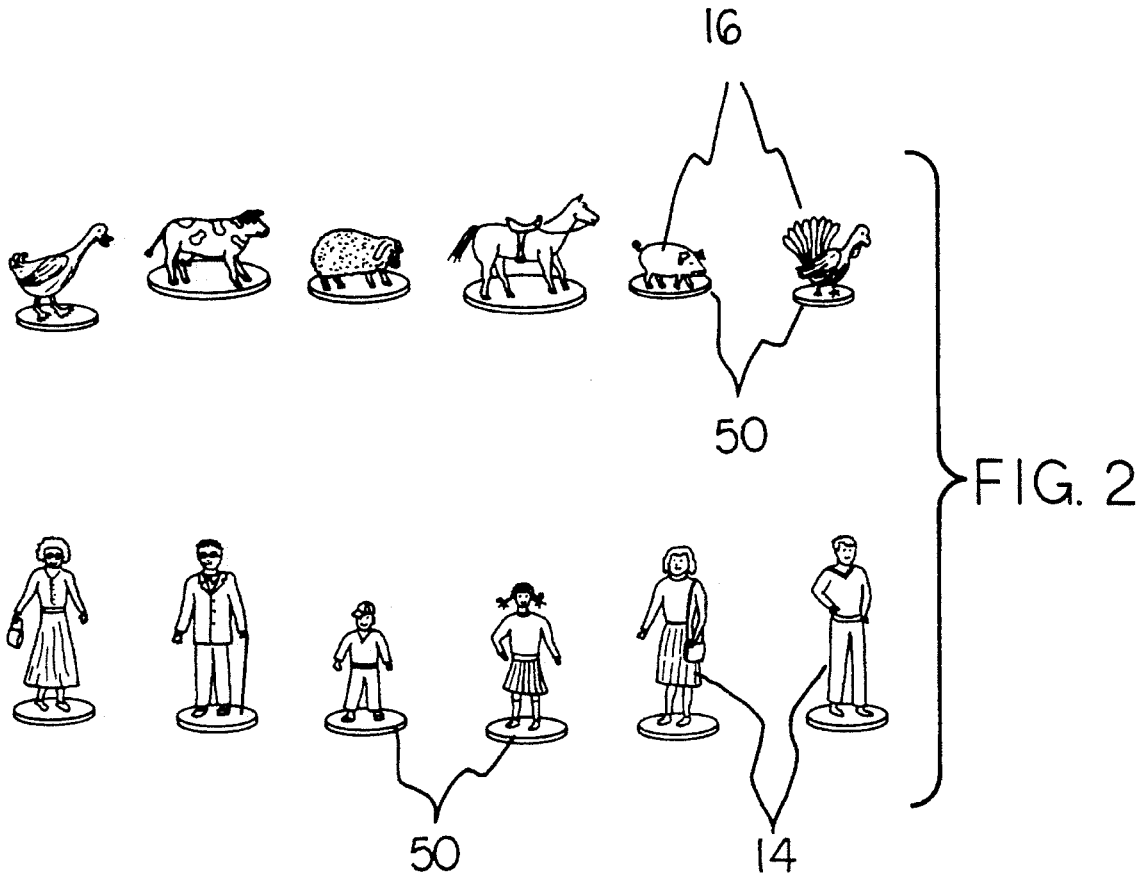
FIG. 2 is a perspective illustration of the player tokens and game board characters of the apparatus.
Figure 3:
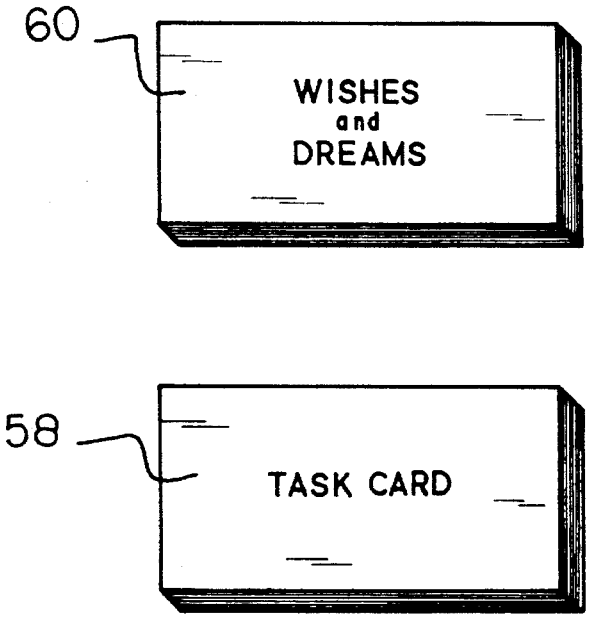
FIG. 3 is a perspective illustration of the playing cards of the apparatus.
Figure 5:
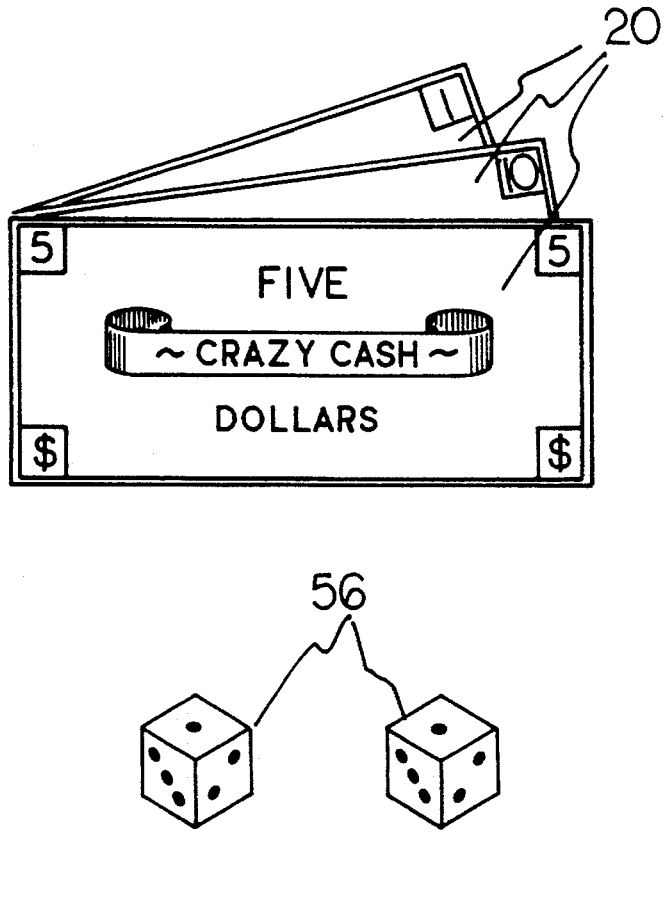
FIG. 5 is a perspective illustration of the play money and dice of the apparatus.

A plurality of human characters 14 and animal characters 16 are included with the apparatus. The human characters are named Grandma, Grandpa, Mom, Dad, Boy and Girl. The animal characters are a Bear, Sheep, Cow, Horse, Dog, and Chicken. Each character is positioned on a generally planar base 50 to permit movement to any location on the game board. Play money 20 is formed in a variety of denominations. In the preferred embodiment of the apparatus the denominations are $1, $5 and $10. A pair of six sided dice 56 are provided for randomly determining the number of spaces a player is to move each turn. Note FIGS. 2 and 5.

Figure 4:
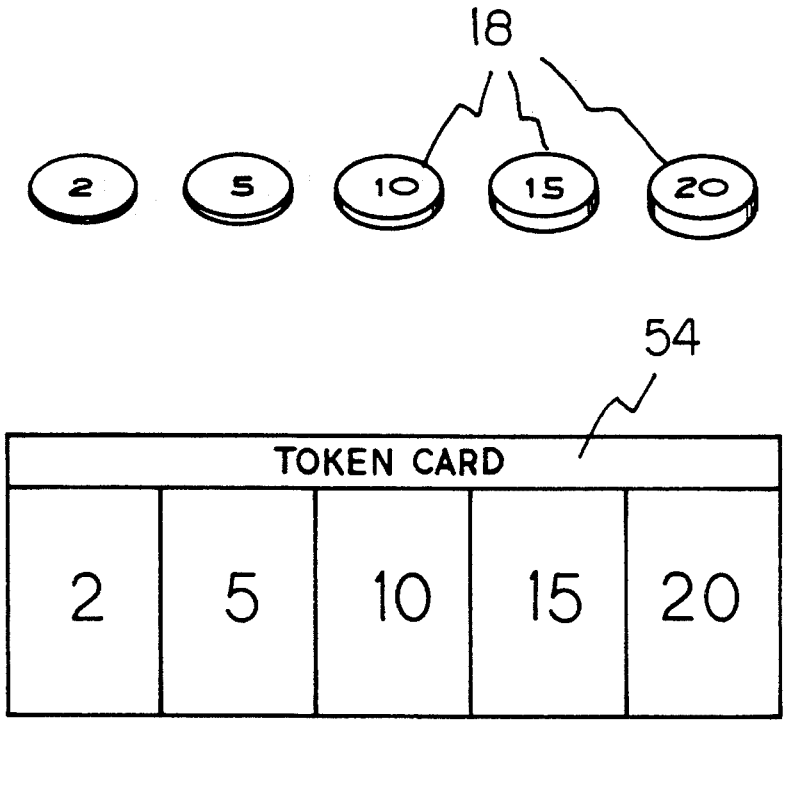
FIG. 4 is a perspective illustration of the tokens and token cards of the apparatus.

The game also includes a plurality of tokens 18 having differing thicknesses and point values imprinted upon them. The increasing thickness of each token varies directly with its value. A token card 54 is provided with the game and includes sections for each token value. The sections are divided as follows: 20, 15, 10, 5 and 2. In an alternative embodiment of the apparatus a measuring scale is included with the game. The scale includes horizontal increments equal to the thicknesses of the various tokens. The scale begins at fifty points and ends at one hundred and sixty points. Using the scale the point totals of each player are easily read to quickly determine a winner. In a further alternative embodiment of the apparatus a plurality of score sheets are utilized to monitor each player's progress as the game continues. in such embodiment the token cards are not necessary. Each score sheet includes a plurality of rows and columns forming boxes. The points corresponding to each game event are recorded in the appropriate box as they are earned. The score sheet provides a concise method of tallying the total points for each player at the end of the game. Note FIGS. 4 and 6.

A TASK CARD deck 58 and a WISHES and DREAMS card deck 60 are also included. The TASK CARD deck is a compulsory feature of the game. The WISHES and DREAMS card desk is an optional feature of the game. The cards of each deck include varying indicia having instructions for the player selecting the card. The card decks are positioned upon their corresponding structures on the front portion of the game board. Each deck contains 16 cards. A summary of the instructional indicia is as follows:

Task Cards (COMPULSORY FEATURE)

1. You lose yourself. Go immediately to the nearest lost parent place.

2. You need some help finding your family group. Go immediately to the nearest lost parent place.

3. You can't wait any longer! Go straight to the nearest restroom.

4. You have sticky hands from that last ice-cream. Go straight to the nearest restroom and wash them.

5. You get a sore foot from too much running around. Go immediately to the nearest First Aid place.

6. The last ride made you feel very unwell. Go straight to the nearest First Aid place.

7. All your money falls out of you pocket on the Niagara Barrel Ride. Return all your money to the bank.

8. You forget your manners while waiting in line. Miss a go.

9. You are caught cutting in a line. Miss a go while you learn to be patient.

10. You forget how to use your imagination. Miss a go while you practice.

11. You get confused about where you are. Go back to the Enchanted Castle to get oriented.

12. You kindly offer a drink to any player who does not have one. Go the nearest food place and buy the drinks. (If you do not have enough cash miss a go.)

13. You hate to see your family looking hungry. Go the nearest food place and buy a snack for a family member who does not have one.

14. Miss a go while you let your spinning head rest.

15. You lose your family in the crowd. Either miss a go looking for them or immediately go to the nearest lost parent place.

16. You misplace your wallet. Return all your money to the bank.

Wishes and Dreams Cards (OPTIONAL FEATURE)

1. You are flown on a magic carpet to the ride of your choice. Go there in one move.

2. You walk into a cloud of fairy dust. Zap! . . . You find yourself at your favorite ride. Go there in one move.

3. Your fairy godmother grants you your wish. Go to your favorite ride in one move.

4. You begin to daydream. Pow! . . . You awake at the top of the roller coaster! Go there in one move.

5. Go to any ride you wish in one move.

6. You begin to wish for a snack. Zap! . . . You got it!

7. A fairy hears you wish for a drink. Before you know it, its yours, free!

8. A free gift is yours for learning to use your imagination. Pick any souvenir.

9. A shooting star falls near you. You catch it and your wish to visit the Enchanted Castle comes true. Go there in one move.

10. A fairy tells you how to make wishes happen. You try it out and find yourself on your favorite ride. Go there in one move.

11. You decide to share your wish with someone. You and that special someone each go on the ride of your own choice. Go there in one move.

12. You overcome your fear of water. For your bravery a fairy magics you to any water ride you choose. Go there in one move.

13. You imagine yourself in a "Land of Make Believe" Tee shirt. Zap! . . . Your wearing it! Keep it for free.

14. You find some fairy dust on the pathway. You use it to magic up a free drink for yourself and one other person.

15. You remember the power of your imagination and very soon are on the Fairy Carousel. Go there in one move.

16. You need to boost your autograph collection. Your wish takes you to the Park's Character of your choice in one move.

A set of playing rules 22 inform the users how to play the game. The rules indicate that each player must start at the ENTRANCE/EXIT area and roll the dice to move their corresponding character. In an alternative embodiment of the apparatus an electronic device is utilized to determine player moves. Each player is required to visit all six major attractions. In addition, each player must visit at least one minor attraction and purchase at least one souvenir and one item of food. Players receive crazy cash of a corresponding dollar amount when they land on a crazy cash path circle. Players landing on a path circle including "wd" within it are required to draw a WISHES AND DREAMS card if this feature is being utilized during play of the game. Players landing on a path circle including a "tc" within it are required to draw a TASK CARD. Players receive tokens with varying point totals based on food and souvenir purchases, visits to star and minor attractions, and exit from the park. A point value summary is shown below:

Points are gained by visiting the six star attractions, minor attractions, purchasing food and souvenirs, having photo's taken with park characters and being the first to exit the park. The following system is used:

| | |
|---|---|
| First to a star attraction | 20 Points |
| Second to sixth to a star attraction | 10 Points |
| Minor attractions | 5 Points |
| Photo with character | 2 Points |
| Food - drink | 2 Points |
| Food - snack | 5 Points |
| Food - meal | 10 Points |
| Souvenirs - balloon | 2 Points |
| Souvenirs - T-shirt | 10 Points |
| Souvenirs - cuddly toy | 15 Points |
| First to exit park | 20 Points |

Players who have visited the six star attractions, at least one minor attraction, and purchased a souvenir and item of food may then return to the ENTRANCE/EXIT area. The first player to exit the park receives 20 points. At this point the game ends. The player with the most token points is declared the winner of the game.

A summary of the game rules is as follows:

To begin the game each player chooses a human character. These characters represent an extended family group. Since their are only six human characters, this represents the player limit. The players then take the six animal characters and position them at random on the paths running throughout the board. One player takes on the role of banker/scorekeeper. The banker then gives each player $10 (2×$5) in play money. The dice are rolled by each player to determine the player turn sequence. The highest roll goes first, lowest last, etc. Play moves clockwise around the board.

Upon entering the park each player should attempt to visit all six star attractions using the footpaths and railroad. Double points are given to the player who reaches each of the star attractions first. The points are recorded by either of the score keeping methods mentioned above. The dice are rolled and the players move that amount of circles along the paths. Reaching an attraction, store, railroad station or public convenience ends the move. If traveling between train stations, the player does not roll the dice. Each station to station move constitutes one turn.

Each player is given $10 in play money to start the game. Additional money is earned during play of the game by landing on path circles with dollar values inside of them. Items can be purchased in the appropriate stores within the park. Purchases are recorded by the scorekeeper. A player landing on a "task card" path circle must select a card from the top of the task card deck. A player landing on a "wishes and dreams" path circle must select a card from the top of the "wishes and dreams" card deck if this feature is being utilized during play of the game. They must immediately carry out the instructions on the card. If the task card requires a player to use money that she does not have, that player loses their next turn.

Players may stop to have their photo taken with the park characters as they make their way along the paths of the game. Two points are then awarded and the move ends. The player must continue in the same direction as before and can only visit each character once.

The game ends when a player who has visited all six star attractions exits the park. Twenty points are given to this player for being the first to leave the park. Points are added up and the winner is the player with the most points. This may not in fact be the first person to leave the park. Money held by each player at the end of the game is not added to the score.

Some additional rules are as follows:

Players can only change direction once they have reached an attraction, store, railroad station or public convenience. Landing on one of these structures ends the move.

Two or more players may occupy the same spot.

Only one item of food or souvenir may be purchased in any one turn.

Only one item from each category of food and souvenirs can be purchased by each player, ie. one drink, one snack and one meal.

Each attraction can only be visited once.

Each person must maintain their direction on the path until they reach an attraction or other park facility or instructed otherwise.

Players should base their decision on whether or not to exit the park or stay to accumulate further points upon the progress of other players.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved theme park board game comprising, in combination:

a game board formed in a planar generally rectangular configuration with parallel long side edges, parallel short side edges, a front portion and a rear portion, the front portion of the board including two structures with the indicia TASK CARD and WISHES and DREAMS imprinted therebelow, the board including a generally rectangular shaped railroad track with rounded corners, the track including a train with a plurality of trailing cars positioned thereupon, the front side edge of the railroad track including the indicia ENTRANCE/EXIT and its related structures positioned adjacent thereto, the interior of the track including a plurality of structures simulating the star attractions, minor attractions, rides, vendor and food areas normally found in a theme park, the various structures being connected by a plurality of paths including path circles therein, some of the path circles entitling the players to receive game related aids and obstacles, the board including a generally cylindrical shaped ENCHANTED CASTLE extending upwardly from its approximate center point;

a plurality of human and animal characters being included with the apparatus, each character being positioned on a generally planar base to permit movement to any location on the board, the game also including: a plurality of tokens having differing thicknesses and point values imprinted thereupon, a token card including sections for each token value, play money being formed in a variety of denominations, a TASK CARD deck and a WISHES and DREAMS card deck, the cards of each deck including varying indicia with instructions to the player selecting the card, the card decks being positioned upon their corresponding structures on the game board, and a pair of six sided dice for randomly determining the number of spaces a player is to move each turn; and a set of playing rules informing the users how to play the game, the rules indicating that each player must start at the ENTRANCE/EXIT area and roll the dice to move their corresponding character, each player being required to visit all six major attractions, at least one minor attraction, and purchase at least one souvenir and one item of food, players receiving crazy cash of a corresponding dollar amount when landing on a crazy cash path circle, players landing on a path circle including wd therein being required to draw a WISHES AND DREAMS card, players landing on a path circle including a tc therein being required to draw a TASK CARD, players receiving tokens with varying point totals based on food and souvenir purchases, visits to star and minor attractions, and exit from the park, player having visited the six star attractions may return to the exit at which point the game ends, the player with the most token points being declared the winner of the game.

2. A theme park board game comprising:

a game board formed in a planar configuration and including a plurality of structures simulating the star attractions, minor attractions, rides, vendor and food areas normally found in a theme park, the various structures being connected by a plurality of circles, the circles granting players various game related aids and obstacles;

the game having a plurality of accessories including: human and animal characters, tokens having differing thicknesses and point values imprinted thereupon, a score tallying device, chance means, play money formed in a variety of denominations, at least one set of playing cards including a variety of different instructional indicia; and a set of playing rules informing the users how to play the game, each player moving their chosen character the number of circles dictated by the chance means, the players being required to visit specified board structures, players accumulating token points as they traverse the circles and structures of the game, the player with the most token points at the end of the game being declared the winner.

3. The apparatus as set forth in claim 2 wherein the score tallying method is a token card having sections for each token value, the token card adapted to retain a plurality of tokens of varying thicknesses thereupon.

4. The apparatus as set forth in claim 3 wherein a measuring scale is included with the apparatus, the scale including horizontal increments equal to the thicknesses of the various tokens, the scale beginning at fifty points and ending at one hundred and sixty points, the point totals of each player being easily read from the scale to quickly determine a winner.

5. The apparatus as set forth in claim 2 wherein the score tallying method is a plurality of score sheets designed to monitor each player's progress as the game continues, each score sheet including a plurality of rows and columns forming boxes, the points corresponding to each game event being recorded in the appropriate box as they are earned, the score sheet providing a concise method of tallying the total points for each player at the end of the game.

6. The apparatus as set forth in claim 2 and further including:

a generally cylindrical shaped ENCHANTED CASTLE extending upwardly from the approximate center point of the game board.

7. The apparatus as set forth in claim 2 wherein the chance means is a pair of six sided dice.

8. The apparatus as set forth in claim 2 wherein the chance means is an electronic device.

* * * * *